US008807450B2

(12) United States Patent
Kronberger

(10) Patent No.: US 8,807,450 B2
(45) Date of Patent: Aug. 19, 2014

(54) INJECTION SYSTEM AND METHOD FOR PRODUCING AN INJECTION SYSTEM

(75) Inventor: Maximilian Kronberger, Steyr (AT)

(73) Assignee: Continental Automotive GmbH, Hannover (DE)

( * ) Notice: Subject to any disclaimer, the term of this patent is extended or adjusted under 35 U.S.C. 154(b) by 1046 days.

(21) Appl. No.: 12/306,459

(22) PCT Filed: Oct. 2, 2006

(86) PCT No.: PCT/EP2006/009554

§ 371 (c)(1),
(2), (4) Date: Feb. 23, 2009

(87) PCT Pub. No.: WO2008/003347

PCT Pub. Date: Jan. 10, 2008

(65) Prior Publication Data

US 2009/0200406 A1 Aug. 13, 2009

(30) Foreign Application Priority Data

Jul. 7, 2006 (DE) ..... 10 2006 031 567

(51) Int. Cl.

| | |
|---|---|
| ***F02D 1/06*** | (2006.01) |
| ***F02M 47/02*** | (2006.01) |
| ***B05B 1/08*** | (2006.01) |
| ***F02M 61/00*** | (2006.01) |
| ***B05B 1/30*** | (2006.01) |

(52) U.S. Cl.
USPC .... 239/5; 239/102.2; 239/533.12; 239/585.5; 239/89; 239/90; 239/91; 239/92

(58) Field of Classification Search
USPC ..... 239/5, 102.1, 102.2, 585.1–585.5, 239/88–92, 584, 533.9, 533.13; 251/229, 251/231, 58, 129.01, 129.2
See application file for complete search history.

(56) References Cited

U.S. PATENT DOCUMENTS 3,945,261 A * 3/1976 Wright ..... 74/110
3,995,813 A * 12/1976 Bart et al. ..... 239/584

(Continued)

FOREIGN PATENT DOCUMENTS

DE 199 39 523 A1 3/2001 ..... F16K 31/02
DE 19939523 A1 3/2001

(Continued)

OTHER PUBLICATIONS

Indian Office Action, Application No. 195/DELNP/2009, 2 pages, Apr. 15, 2014.

*Primary Examiner* — Jason Boeckmann
*Assistant Examiner* — Steven M Cernoch
(74) *Attorney, Agent, or Firm* — King & Spalding L.L.P.

(57) ABSTRACT

An injection system (1) for injecting fuel at a predetermined fuel pressure has: an actuator (2, 3) providing a stroke for lifting an injector needle (4) that opens a nozzle into which the fuel is injected; a leverage apparatus (5) for translating the provided stroke into a modified stroke, the apparatus has a compensating device (6) coupled to the actuator (2, 3), and a lever device (7), which is coupled to the injector needle (4), wherein the lever device has at least two symmetrically disposed, single-arm levers (8*a*, 8*b*), which each come in contact with an injector needle head (10) of the injector needle (4) when lifting the injector needle (4) by means of a single needle head support (9*a*, 9*b*); and wherein the compensating device (6) is suited to compensate a varying force application of the actuator (2, 3) on the single-arm lever (8*a*, 8*b*).

21 Claims, 6 Drawing Sheets

(56) References Cited

U.S. PATENT DOCUMENTS

| | | | | |
|---|---|---|---|---|
| 4,211,119 | A * | 7/1980 | Wolber | 73/721 |
| 4,733,822 | A * | 3/1988 | Romann | 239/585.3 |
| 5,027,857 | A * | 7/1991 | Champseix | 137/625.44 |
| 5,069,189 | A * | 12/1991 | Saito | 123/533 |
| 5,337,785 | A * | 8/1994 | Romer | 137/625.65 |
| 5,653,422 | A * | 8/1997 | Pieloth et al. | 251/129.2 |
| 5,697,554 | A * | 12/1997 | Auwaerter et al. | 239/88 |
| 5,788,161 | A * | 8/1998 | Potz et al. | 239/533.13 |
| 6,089,538 | A * | 7/2000 | Shirkhan | 251/129.17 |
| 6,142,443 | A * | 11/2000 | Potschin et al. | 251/57 |
| 6,318,408 | B1 * | 11/2001 | Fukano et al. | 137/625.44 |
| 6,394,136 | B1 * | 5/2002 | Rohrbeck | 137/625.44 |
| 6,531,712 | B1 | 3/2003 | Boecking | 257/57 |
| 6,607,178 | B1 * | 8/2003 | Lixl et al. | 251/229 |
| 6,772,965 | B2 * | 8/2004 | Yildirim et al. | 239/533.3 |
| 6,783,337 | B2 * | 8/2004 | Nelson | 417/454 |
| 6,805,329 | B2 | 10/2004 | Kegel | |
| 6,933,660 | B2 * | 8/2005 | Maushard et al. | 310/331 |
| 7,490,812 | B2 * | 2/2009 | Scheibe | 251/298 |
| 2001/0032612 | A1 * | 10/2001 | Welch et al. | 123/294 |
| 2003/0127617 | A1 | 7/2003 | Kegel | |
| 2003/0160202 | A1 * | 8/2003 | Boecking | 251/229 |
| 2003/0227232 | A1 * | 12/2003 | Maushard et al. | 310/328 |
| 2005/0156057 | A1 * | 7/2005 | Hamann et al. | 239/102.2 |

FOREIGN PATENT DOCUMENTS

| | | | | |
|---|---|---|---|---|
| DE | 101 01 799 | A1 | 7/2002 | F16K 31/02 |
| DE | 10101799 | A1 | 7/2002 | |
| DE | 101 04 617 | A1 | 8/2002 | F16K 31/02 |
| DE | 10104617 | A1 | 8/2002 | |
| DE | 102 42 376 | A1 | 3/2004 | F02M 57/02 |
| DE | 10242376 | A1 | 3/2004 | |
| DE | 102 54 186 | A1 | 6/2004 | F02M 45/00 |
| DE | 10254186 | A1 | 6/2004 | |
| DE | 10145620 | B4 | 3/2006 | |

* cited by examiner

INJECTION SYSTEM AND METHOD FOR PRODUCING AN INJECTION SYSTEM

CROSS-REFERENCE TO RELATED APPLICATIONS

This application is a U.S. National Stage Application of International Application No. PCT/EP2006/009554 filed Oct. 2, 2006, which designates the United States of America, and claims priority to German Application No. 10 2006 031 567.7 filed Jul. 7, 2006, the contents of which are hereby incorporated by reference in their entirety.

TECHNICAL FIELD

The invention relates to an injection system and to a method for manufacturing an injection system.

BACKGROUND

Injection systems with at least one injector and especially leakage-oil-free common-rail-injection systems demand a control element or an actuator, such as a piezoactuator for example, in the high-pressure chamber of the injector. The technical field of the invention relates in particular to piezo-controlled common-rail injectors or injection systems without leakage oil return with an actuator or an actuator for opening and closing a nozzle by means of an injector needle in the high-pressure chamber which features a hydraulic length compensation facility and a lever transmission for actuating the injector needle. The length compensation facility especially features a piston engaging in a hole of the base plate of the piezo stack of the piezoactuator, a hydraulic volume, for example a volume of fuel, between the base plate and the piston and a return spring for resetting the piezo stack. Such an injection system is for example known from DE 101 45 620 B4.

The function of the above-mentioned lever transmission is to translate the stroke provided by the piezo stack into a modified, especially increased, stroke. To this end the lever transmission generally features an actuator lever which is coupled to the piezoactuator and a needle lever which is coupled to the injector needle. The actuator needle and the needle lever form a two-stage lever facility which, as a result of its two-stage nature, needs a large mounting height. The applicant has established in a trial with such a lever transmission that on actuation of the lever the tipping moment initiated in the injector needle can result in a negative influence on the function. In particular a resulting lateral force acts on the needle during the lifting movement. This produces undesired friction forces in the needle guide which increase the energy required to lift the injector needle. It is also known internally to the applicant that this negative function influence can be corrected by means of an additional guide in the area of the needle shaft. However a force introduced off-center into the lever transmission leads to increased friction traces in the transition area of the modules, for example between needle lever and injector needle head of the injector needle. This produces high friction losses between these components, for example between the needle lever and the injector needle head. Disadvantageously these friction losses shorten the lifetime of the injection system. These friction losses also cause a loss of energy in the translation or transmission of the stroke provided by the actuator.

SUMMARY

According to various embodiments, an injection system can be created in which an off-center introduction of a force on the injector needle is compensated for.

According to further embodiments, an injection system can be provided with reduced or minimized friction losses.

According to further embodiments, a simple and especially cost-effective injection system can be created with a transmission lever with especially minimal friction losses.

According to further embodiments, a simple and especially cost-effective injection system can be created with a reduced or minimized length.

According to an embodiment, an injection system for injection of fuel at a predetermined fuel pressure may comprise: a) an actuator, which provides a stroke for lifting an injector needle which opens a nozzle into which the fuel is injected; b) a lever transmission facility for translating the stroke provided into a modified stroke, which features a compensation device which is coupled to the actuator and a lever device which is coupled to the injector needle, c) wherein the lever device comprises at least two symmetrically-arranged single-arm levers which each contact by means of an individual needle head support an injector needle head of the injector needle during lifting of the injector needle; and d) wherein the compensation device is suitable for compensating for a different force effect of the actuator on the single-arm levers.

According to a further embodiment, the actuator may be embodied as a magnetic actuator or as a piezoactuator. According to a further embodiment, the magnetic actuator may have a flat armature or a plunger armature. According to a further embodiment, the magnetic actuator with the plunger armature may have an ancillary air gap. According to a further embodiment, the magnetic actuator with the flat armature may have a torus coil or a toroidal coil, wherein the flat armature especially having a square cross-section. According to a further embodiment, the single-arm levers may be separated from each other by means of a separation gap. According to a further embodiment, a hydraulic compensator may be provided which features a compensator bowl and a piston engaging in the compensator bowl, with a space being embodied between the compensator bowl and the piston which is filled with a fluid, especially the fuel, with the space being coupled for hydraulic compensation to a compensation volume via a flow gap. According to a further embodiment, a base plate of the piezoactuator may be coupled to the compensator bowl and the compensation device features the piston. According to a further embodiment, a base plate of the piezoactuator may be coupled to the piston and the compensation device features the compensator bowl. According to a further embodiment, the piezoactuator may features a controllable piezo stack which, depending on a control signal, provides the stroke for actuating the injector needle in a closing direction or in an opening direction.

According to another embodiment, a method for manufacturing an injection system for injection of fuel at a predetermined fuel pressure may comprise the following steps: a) Arrangement of an actuator in a housing of the injection system, which provides a stroke for lifting an injector needle which opens a nozzle into which the fuel is injected; and b) Coupling the actuator to a lever translation facility for translating the stroke provided into a modified, especially increased stroke, which features a compensation device which is coupled to the actuator, and a lever device which is coupled to the injector needle, with the lever device featuring at least two symmetrically-arranged single-arm levers which in each case by means of an individual needle head support contact an injector needle head of the injector needle for lifting the injector needle, with the compensation device being suitable for compensating for a different force effect of the actuator on the single-arm levers.

BRIEF DESCRIPTION OF THE DRAWINGS

The invention will be explained in greater detail below with reference to the exemplary embodiments shown in the schematic figures of the drawings. The figures are as follows.

In all figures identical elements or elements and apparatus with the same functions—unless otherwise indicated—have been labeled with the same reference symbols.

DETAILED DESCRIPTION

Figure 1:
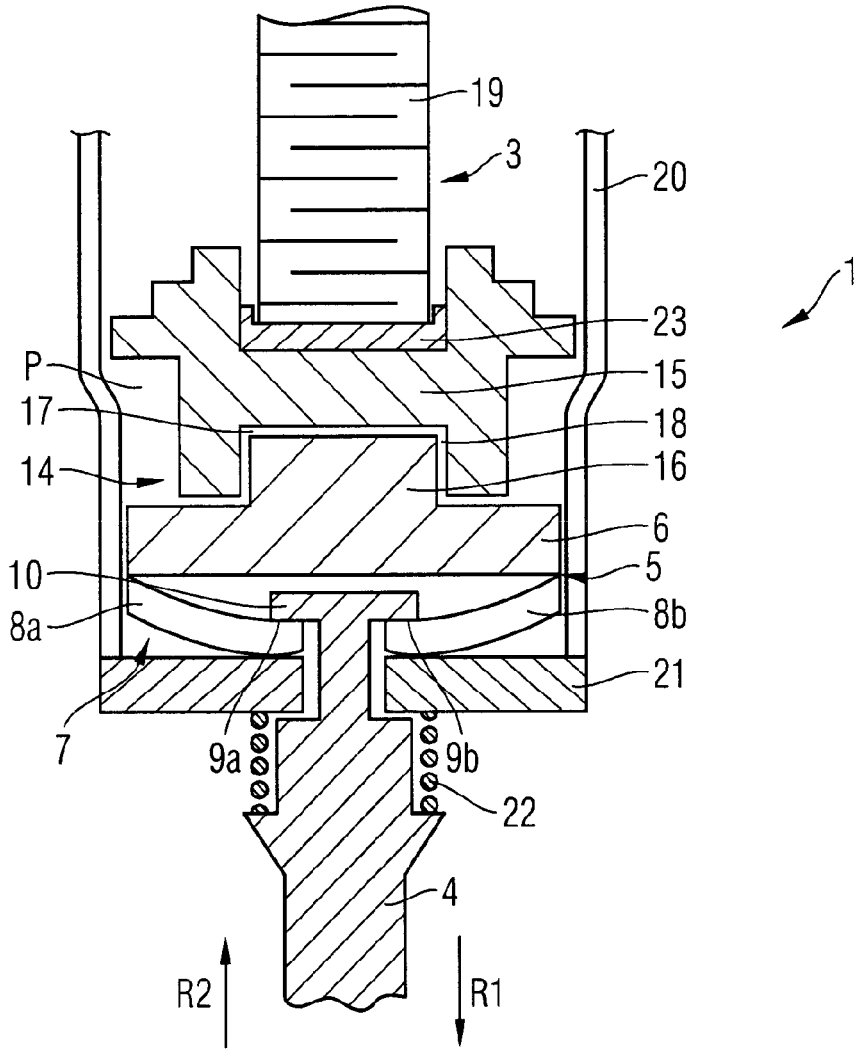
FIG. 1 a schematic block diagram of a first exemplary embodiment of the injection system.

According to various embodiments, an injection system for injection of fuel at a predetermined fuel pressure may comprise:

An actuator, which provides a stroke for lifting an injector needle which opens a nozzle into which the fuel is injected;

A lever transmission facility for translating the stroke provided into a modified stroke which has a compensation device which is coupled to the actuator, and a lever device which is coupled to the injector needle, with the lever device featuring at least two symmetrically-arranged, single-arm levers which each contact an injector needle head of the injector needle by means of an individual needle head support when the injector needle is lifted; and with the compensation device being suitable for compensating for a different force effect of the actuator on the single-arm levers.

In addition a method is proposed for manufacturing an injection system for injecting fuel at a predetermined fuel pressure which features the following steps:

Arrangement of an actuator in a housing of the injection system which provides a stroke for lifting an injector needle which opens a nozzle into which the fuel is injected;

Coupling the actuator to a lever transmission device for translating the stroke provided into a modified, especially increased, stroke which features a compensation device which is coupled to the actuator and a lever device which is coupled to the injector needle, with the lever device featuring at least two symmetrically arranged, single-arm levers, which each contact by means of an individual needle head support an injector needle head of the injector needle for lifting the injector needle, with the compensation device being suitable for compensating for a different force effect of the actuator on the single-arm lever.

Advantageously the result of the arrangement of the compensation device between the actuator and the lever device is that a potential different force effect of the actuator on the single-arm levers of the lever device is compensated for and thus no lateral force effect of the lever device on the injector needle can occur. This produces on the one hand a lower friction effect as a result of the reduced friction and on the other a smaller energy requirement for lifting the injector needle. Furthermore the single-arm levers of the lever device are constructed symmetrically, especially rotation-symmetrically, so that both on the drive and also on the needle no transverse forces resulting from friction and transverse movements can be entered into the system, which in its turn would lead to an increased friction at the components coupled to them. Overall the arrangement according to various embodiments enables friction arising between the components or elements of the injection system during the transmission of the stroke to be reduced. The result of this reduction of friction losses according to various embodiments is an improvement in the durability and the lifetime of the injection system.

A further advantage of the arrangement of the compensation device lies in the fact that a non-coaxial arrangement of the actuator and the lever transmission facility is possible without an inhomogeneous force effect of the actuator on the single-arm levers of the lever transmission facility having to be taken into account. This produces a degree of freedom for the embodiment of the construction of the injection system.

A further advantage of the various embodiments lies in the fact that two-stage levers do not have to be used. As a result of the use of single-arm levers a reduced or minimized length of the lever transmission facility and thus of the injection system is produced. Furthermore the injection system according to various embodiments has lower manufacturing costs because of the omission of components, especially two identical levers.

In accordance with an embodiment the actuator is embodied as a magnetic actuator or as a piezoactuator.

In accordance with a further development the magnetic actuator has a flat armature or a plunger armature.

In accordance with a further development the magnetic actuator with the plunger armature has an ancillary air gap.

Advantageously the use of the ancillary air gap results in the magnetic actuator being able to provide a linear force curve over the stroke.

In accordance with a further embodiment the magnetic actuator with the flat armature has a torus coil or a toroidal coil. The flat armature preferably has a square cross-section.

In accordance with a further embodiment the single-arm levers are separated by means of a separating gap.

In accordance with a development a hydraulic compensator is provided which has a compensator bowl and a piston engaging in the compensator bowl, with a space being embodied between the compensator bowl and the piston, which is filled with a fluid, especially fuel, with the space being coupled for hydraulic compensation to a compensating volume via a flow gap. Use of the hydraulic compensator advantageously enables tolerances of the components of the injection system as well as temperature expansion effects to be compensated for.

In accordance with a further embodiment a base plate of the piezo actuator is coupled to the compensator and the compensation device features the piston. The movability of the compensation device or of the compensation element necessary for the force equalization is ensured by a comparatively short cylindrical area of the sealing surface of the piston. The maximum length of this area depends on the play necessary for length compensation. Alternatively a spherical sealing surface can also be provided.

In accordance with a further embodiment the base plate of the piezoactuator is coupled to the piston and the compensation element features the compensator bowl.

in accordance with a further embodiment the piezo actuator features a controllable piezo stack. Depending on a control signal, the controllable piezo stack sets the stroke for actuating the injector needle in a closing direction or in an opening direction.

The exemplary embodiments of the injection system 1 for injection of fuel P at a predetermined fuel pressure in accordance with FIGS. 1-5 have in common the fact that the injection system 1 according to various embodiments features an actuator 2, 3 and a lever transmission facility 5 with a compensation device 6 and a lever device 7. In all these cases the actuator 2, 3 provides a stroke for lifting an injector needle 4 which opens a nozzle into which the fuel P is injected. The lever transmission facility 5 for translating the stroke provided into a modified stroke therefore has the compensation device 6 which is coupled to the actuator 2, 3 and the lever device 7 which is coupled to the injector needle 4. In this case the lever device 7 features at least two symmetrically-arranged, single-arm levers 8*a*, 8*b* which respectively use an individual needle head support 9*a*, 9*b* to contact an injector needle head 10 of the injector needle 4 during the lifting of the injector needle 4. Furthermore the compensation device 6 is suitable for compensating for a different or inhomogeneous force effect of the actuator 2, 3 on the single-arm levers 8*a*, 8*b* according to various embodiments.

Figure 2:
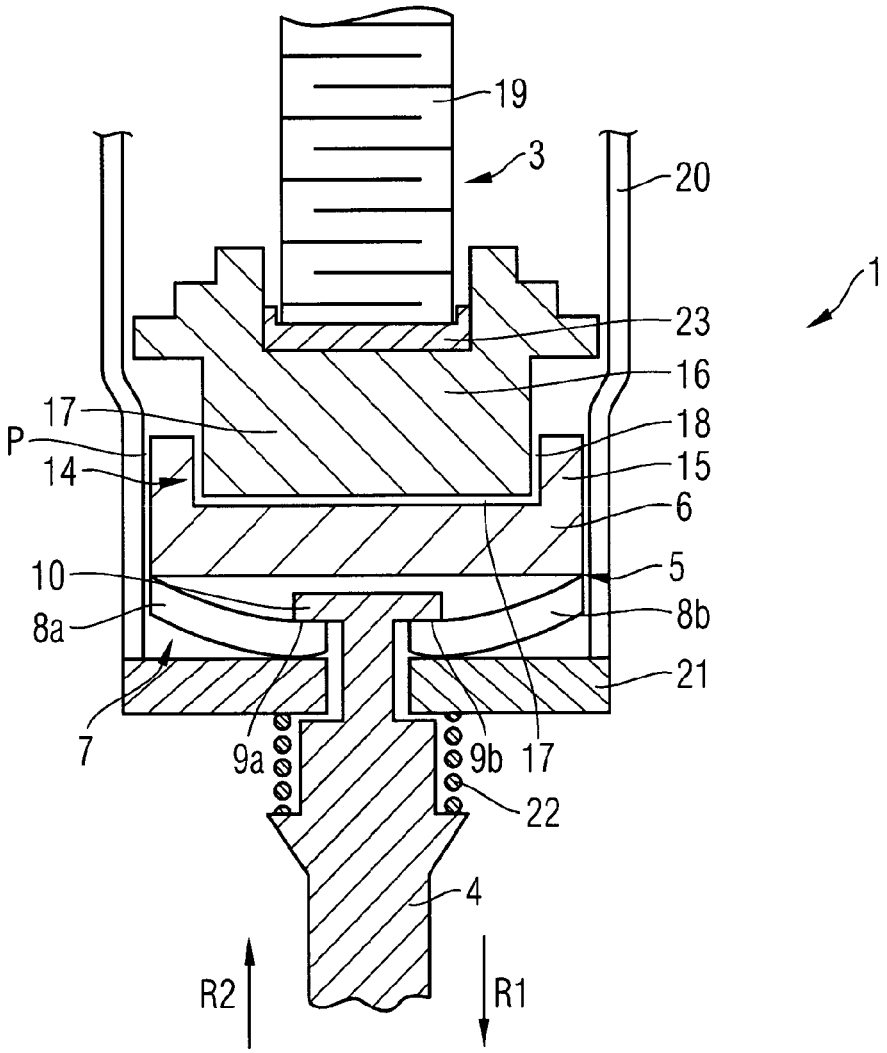
FIG. 2 a schematic block diagram of a second exemplary embodiment of the injection system.

In accordance with the first exemplary embodiment in accordance with FIG. 1 and the second exemplary embodiment in accordance with FIG. 2 the injection system 1 also features a hydraulic compensator 14. The hydraulic compensator 14 possesses a compensator bowl 15 and a piston 16 engaging in the compensator bowl 15. Embodied between the compensator bowl 15 and the piston 16 is a space 17 which is filled with a fluid, especially the fuel P. The space 17 is coupled for hydraulic compensation to a compensation volume via a flow gap 18.

The injection system 1 in accordance with FIGS. 1 and 2 also has a piezoactuator 3 as an actuator. The piezoactuator 3 features a controllable piezo stack 19 which, depending on a control signal (not shown), provides the stroke for actuating the injector needle 4 in a closing direction R1 or in an opening direction R2. For sealing the piezo stack 19 is surrounded by a corrugated tube (not shown). The closing of the injector needle 4 in the closing direction R1 is however essentially undertaken by a spring (not shown) which generates the necessary closing force which is suitable when the piezo stack 19 is discharged and returns to a predetermined initial position.

Furthermore the injection system 1 according to FIGS. 1-5 has a support device 21 which supports the lever device 7. In particular the single-arm levers 8*a*, 8*b* roll off the support device 21 during the transmission of the stroke. Furthermore the injection system 1 preferably features a reset spring 22 for resetting the injector needle 4 which couples the injector needle 4 to the housing 20 or to the support device 21.

Figure 3:
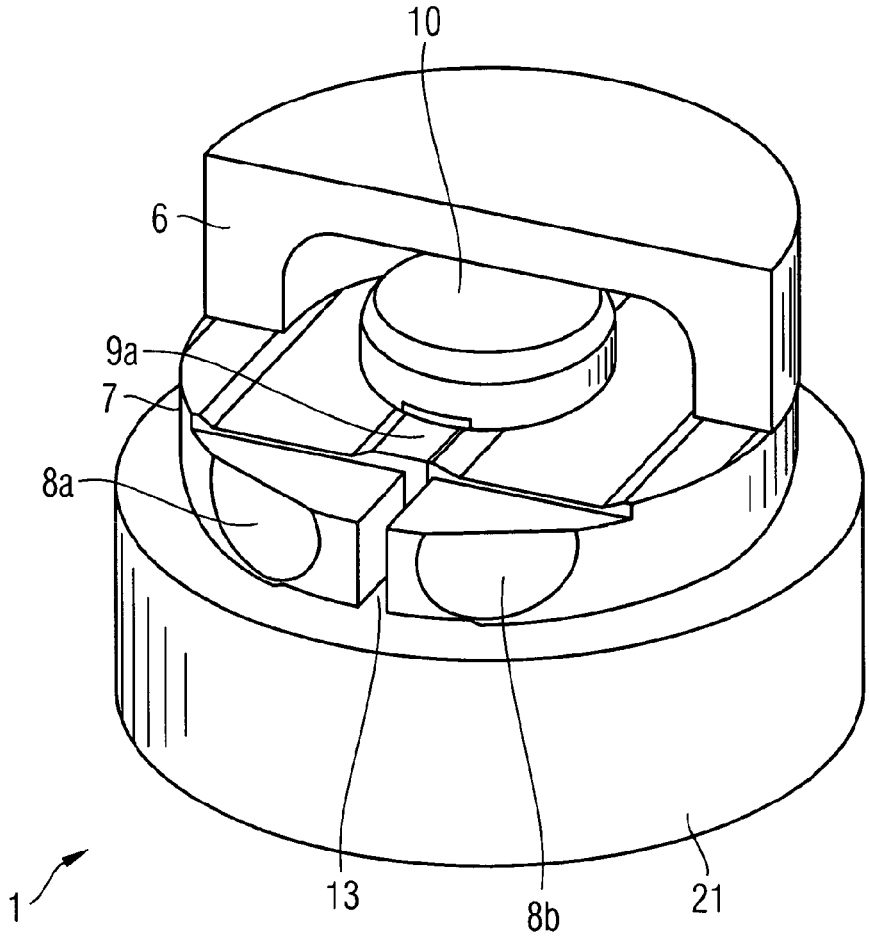
FIGS. 3, 4 detailed views of a section of a third exemplary embodiment of the injection system.
Figure 4:
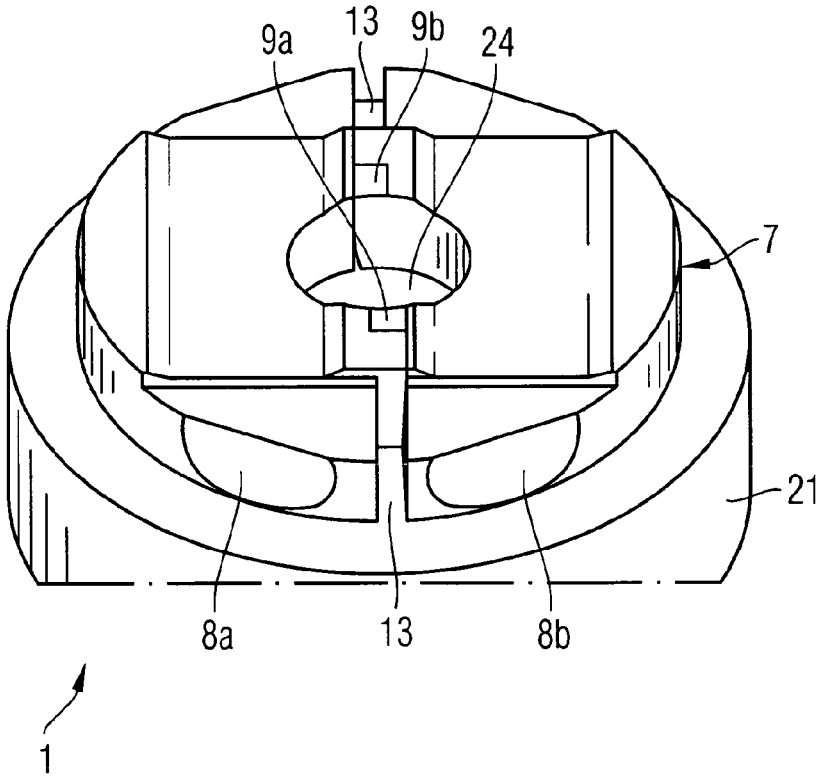

In accordance with the first exemplary embodiment depicted in FIG. 1 a base plate 23 of the piezoactuator 3 is coupled to the compensator bowl 15 and the compensation device 6 features the piston 16. Alternatively in accordance with the second exemplary embodiment as depicted in FIG. 2, the base plate 23 of the piezoactuator 3 can be coupled to the piston 16 and the compensation device 6 can feature a compensator bowl 15. FIGS. 3 and 4 show detailed views of a section of a third exemplary embodiment of the injection system 1. FIGS. 3 and 4 show in particular the lever transmission facility 5 with the compensation device 6 and the lever device 7. The lever device 7 features two symmetrically arranged single-arm levers 8*a*, 8*b*.

A single-arm lever 8*a*, 8*b* in the sense of this application is a lever which is formed at least to one side like a single-armed fork. This one side is the side of the lever with which it lifts the injector needle head 10. The single-arm lever 8*a*, 8*b* is essentially embodied as a U shape. The single-arm levers 8*a*, 8*b* contact the injector needle head 10 of the injector needle 4 for lifting the injector needle 4 in each case by means of an individual needle head support 9*a*, 9*b*. The lifting of the injector needle 4 by the single-arm levers 8*a*, 8*b* causes the injector needle 4 to be equally lifted in a rotational movement out of the injector needle seat (not shown). Greatly reduced friction losses thus occur between the injector needle head 10 and the respective single-arm levers 8*a*, 8*b*. Preferably the single-arm levers 8*a*, 8*b* have a convex contour in a contact area to the support device 21, on which the one-sided levers 8*a*, 8*b* are supported. In particular the single-arm levers 8*a*, 8*b* are separated from each other by means of a separation gap 13. Reference symbol 24 in FIG. 4 indicates a hole for the injector needle 4.

Figure 5:
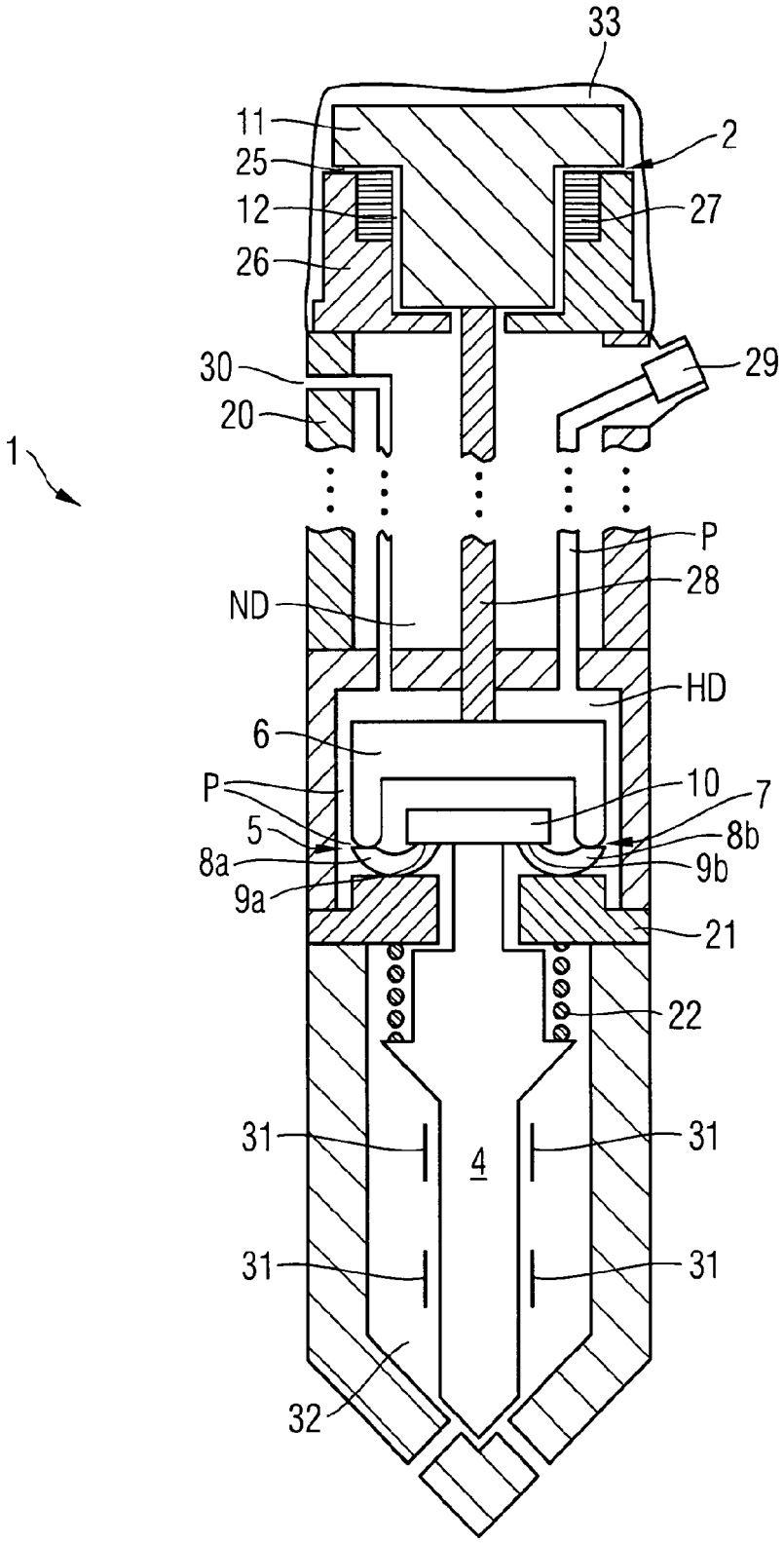
FIG. 5 a schematic block diagram of a fourth exemplary embodiment of the injection system.

FIG. 5 shows a fourth exemplary embodiment of the injection system 1. The fourth exemplary embodiment of the injection system 1 as depicted in FIG. 5 differs especially from the first and second exemplary embodiment as depicted in FIGS. 1 and 2 to the extent that a piezoactuator 3 is not used as an actuator, but instead as a magnetic actuator 2. FIG. 5 shows a magnetic actuator 2 with a plunger armature 11. As an alternative to the embodiment with a plunger armature 11*a* magnetic actuator 2 with a flat armature can also be used.

The magnetic actuator 2 as depicted in FIG. 5 with the plunger armature 11 has an ancillary air gap 12 between the coil 27 and the plunger armature 11. The coil 27 is coupled to a magnetic bowl 26. A working air gap 25 is formed in a vertical direction above the coil 27 between the coil 27 and the plunger armature 11.

The stroke of the magnetic actuator 2 is transmitted by means of a plunger 28 to the compensation device 6. In such cases the magnetic actuator 2 is arranged in a low-pressure area ND of the injection system 1 and the lever transmission facility 5 as well as the injector needle 4 and potential intermediate coupled devices are arranged in the high-pressure are HD of the injection system 1.

FIG. 5 also shows a high-pressure connection 29 for feeding the fuel P at the predetermined fuel pressure, which for example lies in a range of 1500-2000 bar. FIG. 5 also shows a leakage oil connection 30 which is coupled to the high-pressure area HD of the injection system 1.

FIG. 5 also shows the arrangement of needle guides 31 in a needle shaft 32 for improved guidance of the injector needle 4. Naturally the needle guides 31 can also be used in the previous exemplary embodiments. Furthermore a encapsulation 33 protects the magnetic actuator 2 against outside influences.

Figure 6:
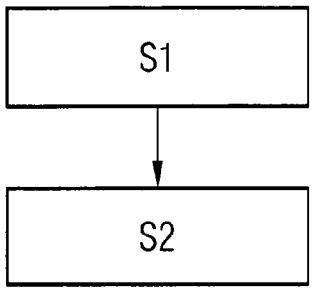
FIG. 6 a schematic flowchart of a preferred exemplary embodiment of the method.

FIG. 6 shows a schematic flowchart of a preferred exemplary embodiment of the method for manufacturing an injection system 1 for injection of fuel P at a predetermined fuel pressure. The method in accordance with various embodiments is illustrated below with reference to the block diagram in FIG. 6. The method has the following method steps S1-S2:

Method Step S1:

An actuator 2, 3 is arranged in a housing 20 of the injection system 1 which provides a stroke for lifting an injector needle 4 which opens a nozzle into which the fuel P is injected.

Method Step S2:

The actuator 2, 3 is coupled to a lever transmission facility 5 for translating the stroke provided into a modified, especially increased stroke. The lever transmission facility 5 features a compensation device 6 or compensation plate which is coupled to the actuator 2, 3 and a lever device 7, which is coupled to the injector needle 4. The lever device 7 has at least two symmetrically-arranged single-arm levers 8*a*, 8*b*, which each contact by means of an individual needle head support 9*a*, 9*b* an injector needle head 10 of the injector needle 4 for lifting the injector needle 4. Furthermore the compensation device 6 is suitable for compensating for a different or inhomogeneous force effect of the actuator 2, 3 on the single-arm levers 8*a*, 8*b* during the transmission of the stroke according to various embodiments.

Although the present invention has been described in the foregoing with reference to the exemplary embodiment, it is not restricted to this embodiment but can be modified in a plurality of ways.

What is claimed is:

1. An injection system for injection of fuel at a predetermined fuel pressure comprising:

an actuator, which provides a stroke for lifting an injector needle in an axial direction which opens a nozzle into which the fuel is injected;

a lever transmission facility for translating the stroke provided into a modified stroke, which lever transmission facility comprises a compensation device which is coupled to the actuator and a lever device which is coupled to the injector needle, wherein the stroke provided by the actuator drives the compensation device in a first direction toward the injector needle;

wherein the lever device comprises at least two symmetrically-arranged single-arm levers which each contact an injector needle head of the injector needle during lifting of the injector needle, wherein each single-arm lever forms a substantially U-shaped semicircle in a plane perpendicular to the axial direction, such that the at least two single-arm levers generally form a circle in the plane perpendicular to the axial direction;

wherein the single-arm levers provide a coupling between the compensation device and the injector needle such that the single-arm levers convert a translation of the compensation device, driven by the actuator, in the first direction to a translation of the injector needle in a second, opposite direction; and wherein the compensation device is suitable for compensating for a different force effect of the actuator on the single-arm levers.

2. The injection system according to claim 1, wherein the actuator is embodied as a magnetic actuator or as a piezoactuator.

3. The injection system according to claim 2, wherein the magnetic actuator has a flat armature or a plunger armature.

4. The injection system according to claim 3, wherein the magnetic actuator with the plunger armature has an ancillary air gap.

5. The injection system according to claim 3, wherein the magnetic actuator with the flat armature has a torus coil or a toroidal coil.

6. The injection system according to claim 1, wherein the single-arm levers are separated from each other by means of a separation gap.

7. The injection system according to claim 2, wherein a hydraulic compensator is provided which comprises a compensator bowl and a piston engaging in the compensator bowl, with a space being embodied between the compensator bowl and the piston which is filled with a fluid, with the space being coupled for hydraulic compensation to a compensation volume via a flow gap.

8. The injection system according to claim 7, wherein a base plate of the piezoactuator is coupled to the compensator bowl and the compensation device comprises the piston.

9. The injection system according to claim 7, wherein a base plate of the piezoactuator is coupled to the piston and the compensation device comprises the compensator bowl.

10. The injection system according to claim 2, wherein the piezoactuator comprises a controllable piezo stack which, depending on a control signal, provides the stroke for actuating the injector needle in a closing direction or in an opening direction.

11. A method for manufacturing an injection system for injection of fuel at a predetermined fuel pressure comprising the following steps:

arranging an actuator in a housing of the injection system, which provides a stroke for lifting an injector needle in an axial direction which opens a nozzle into which the fuel is injected;

coupling the actuator to a lever translation facility for translating the stroke provided into a modified stroke, which lever transmission facility comprises a compensation device which is coupled to the actuator, and a lever device which is coupled to the injector needle, wherein the stroke provided by the actuator drives the compensation device in a first direction toward the injector needle, with the lever device comprising at least two symmetrically-arranged single-arm levers that each contact an injector needle head of the injector needle for lifting the injector needle, wherein each single-arm lever forms a substantially U-shaped semicircle in a plane perpendicular to the axial direction, such that the at least two single-arm levers generally form a circle in the plane perpendicular to the axial direction, and wherein the single-arm levers provide a coupling between the compensation device and the injector needle such that the single-arm levers converts a translation of the compensation device, driven by the actuator, in the first direction to a translation of the injector needle in a second, opposite direction, and wherein the compensation device is operable to compensate for a different force effect of the actuator on the single-arm levers.

12. The method according to claim 11, wherein the modified stroke is an increased stroke.

13. The injection system according to claim 3, wherein the magnetic actuator with the flat armature has a torus coil or a toroidal coil, wherein the flat armature has a square cross-section.

14. The injection system according to claim 7, wherein the fluid is the fuel.

15. A method for injection of fuel at a predetermined fuel pressure comprising the steps of:

providing a stroke by an actuator for lifting an injector needle in an axial direction which opens a nozzle into which the fuel is injected; and translating the stroke provided into a modified stroke by a compensation device coupled to and driven by the actuator and coupled to a lever device which is coupled to the injector needle, wherein the stroke provided by the actuator drives the compensation device in a first direction toward the injector needle, wherein the lever device comprises first and second symmetrically-arranged single-arm levers which each contact an injector needle head of the injector needle during lifting of the injector needle; wherein each single-arm lever forms a substantially U-shaped semicircle in a plane perpendicular to the axial direction, such that the at least two single-arm levers generally form a circle in the plane perpendicular to the axial direction, wherein the single-arm levers provide a coupling between the compensation device and the injector needle such that the single-arm levers convert a stroke of the compensation device, driven by the actuator, in the first direction to a translation of the injector needle in a second, opposite direction;

and wherein the compensation device is suitable for compensating for a different force effect of the actuator on the single-arm levers.

16. The method according to claim 15, comprising the step of separating the single-arm levers from each other by means of a separation gap.

17. The method according to claim 15, comprising the step of providing a hydraulic compensator which comprises a compensator bowl and a piston engaging in the compensator bowl, with a space being embodied between the compensator bowl and the piston which is filled with the fuel, with the space being coupled for hydraulic compensation to a compensation volume via a flow gap.

18. The method according to claim 17, comprising the step of coupling a base plate of a piezoactuator to the compensator bowl wherein the compensation device comprises the piston.

19. The method according to claim 17, comprising the step of coupling a base plate of a piezoactuator to the piston wherein the compensation device comprises the compensator bowl.

20. The method according to claim 15, comprising the step of providing the stroke for actuating the injector needle in a closing direction or in an opening direction by a piezoactuator comprising a controllable piezo stack controlled by a control signal.

21. The injection system according to claim 1, wherein the at least two single-arm levers are distinct, rigid elements.

* * * * *